US005887389A

United States Patent [19]

Light

[11] Patent Number: 5,887,389

[45] Date of Patent: Mar. 30, 1999

[54] DECORATIVE CONSTRUCTION MODULE WITH MARKING INDICIA

[75] Inventor: Richard D. Light, Indianapolis, Ind.

[73] Assignee: Ceramica, Inc., Indianapolis, Ind.

[21] Appl. No.: 956,306

[22] Filed: Oct. 22, 1997

[51] Int. Cl.[6] ..... E04B 1/00

[52] U.S. Cl. ..... 52/105; 52/390; 52/384

[58] Field of Search ..... 52/105, 311.3, 52/384, 385

[56] References Cited

U.S. PATENT DOCUMENTS

| | | | |
|---|---|---|---|
| 4,031,289 | 6/1977 | Sergovic | 52/612 X |
| 4,681,786 | 7/1987 | Brown | 52/390 X |
| 5,208,086 | 5/1993 | Owens | 52/390 X |
| 5,277,009 | 1/1994 | Yamaguchi et al. | 52/387 |
| 5,314,554 | 5/1994 | Owens | 52/390 X |
| 5,322,584 | 6/1994 | Severson et al. | 52/390 X |

FOREIGN PATENT DOCUMENTS

| | | | |
|---|---|---|---|
| 94/06981 | 3/1994 | WIPO | 52/384 |

*Primary Examiner*—Creighton Smith

*Attorney, Agent, or Firm*—Woodard, Emhardt, Naughton Moriarty & McNett

[57] ABSTRACT

A decorative construction module in the form of an address tile for incorporation into the wall of a structure according to one embodiment includes a porcelain tile measuring approximately ⅜ inch thick which has an outer surface inscribed with name/number and/or address information thereon and a backing block fabricated out of expanded polystyrene material and being bonded to the porcelain tile in order to create the completed address tile. The rectangular solid form of the module is sized and shaped so as to fit appropriately within a residential brick wall based upon the typical brick sizes and spacing of the mortar joints. According to another embodiment, a porcelain address tile is bonded directly to the exterior surface of a brick wall with a structural adhesive. In order to hold the tile in place while the structural adhesive cures, a double-sided (peel and stick) adhesive material is applied to the rear surface of the porcelain tile.

22 Claims, 3 Drawing Sheets

DECORATIVE CONSTRUCTION MODULE WITH MARKING INDICIA

BACKGROUND OF THE INVENTION

The present invention relates in general to construction techniques, methods and devices involving stone, brick, expanded polystyrene, limestone, marble, and porcelain and combinations of these materials. More specifically, the present invention relates to placing marking indicia on construction materials (i.e., inscribing), such as stone, brick, limestone, marble, and porcelain for the purpose of creating address stones for houses and for brick "mailboxes".

During the last fifteen to twenty years, there has been a greater interest in producing bricks with names inscribed in them. Such bricks have been used to recognize contributors to civic projects and as a fund raiser. Frequently these inscribed bricks are used in walkways as a way to recognize and memorialize the individual. Occasionally the inscribed bricks are used in a wall, though even here the objective is still the same. During this same time period, limestone address stones were being used and installed directly into the brick wall of the corresponding structure, typically residential. While these decorative construction techniques continued with widespread popularity, there were a variety of technical issues and concerns. While these name bricks are not closely related to address stones, they do represent a current technique of inscribing a construction component.

With respect to the inscribed bricks, the traditional method employed was to stamp the characters directly into the formed, but unburned, brick. A colorant was then added to the indentations, but this proved to be a painstaking operation. The final step of firing the brick resulted in a rejection rate which was relatively high due primarily to the vagaries of the firing process. If mistakes were made in this overall process, either clerical or production-wise, it would delay the completion of the job, assuming that all the named (i.e., inscribed) bricks had to be laid together. An improvement to this method involved sand blasting the characters directly into an already fired brick and thereafter spray staining the characters through the use of a stencil mask.

Since the character height on an inscribed brick is relatively small, inscribed bricks have not normally been used as address stones. Another reason for not using inscribed bricks in this application is the lack of any noticeable visual contrast in color and texture with the remainder of the bricks used in the wall of the structure. Further, the contrast between the brick and the inscription is not dramatic and thus difficult to see from a distance. Further, inscribed bricks within a brick wall does not provide any noticeable or desirable aesthetic combination.

In lieu of metal numbers for the purpose of providing an address for a structure, limestone has been used. The limestone block is sized to fit within a brick wall and in order to fit within the mortar joints, the limestone block is sized in height as a multiple of the standard residential brick height with a corresponding and suitable length depending on the characters to be inscribed and the size and spacing of the residential bricks.

Despite the fame and extensive usage of limestone as a building material, it has several undesirable characteristics. One undesirable characteristic is the inability to control the consistency of the material. The texture of limestone varies from lot to lot such that the surface of each stone section must be belt sanded in order to minimize surface flaws and differences. There are also occasionally harmless but visually offensive fault lines which customers will not normally accept as part of any address stone which is to be mounted into a residential brick wall.

Limestone is a relative soft, absorbent material and the careless cleaning of the stone and surrounding brick after installation into the brick wall can and does cause a yellowish stain which is difficult to remove. It is believed that this stain is an acid burn caused by the cleansing chemical. The worst characteristic of limestone appears primarily when these stones are installed in the increasingly popular brick "mailboxes". Since these mailboxes are otherwise unprotected from the elements, they can become water soaked and, as a result impurities, both from the mortar and from the limestone, enter into solution which migrates to the surface of the limestone, leaving an unacceptable brown appearance. While there are techniques available to coat the limestone with a type of water repellent, this treatment is relatively expensive and is not totally effective. In using limestone for address stones of this type, a customer will typically order two identical address stones, one for the mailbox and the other for the residence. If, in order to reduce cost, only one stone is actually treated with the water repellent, it is important that that particular stone be selected for the mailbox and the untreated stone used for the residence. Unfortunately, it is difficult to visually tell which is which and installers may reverse the two, precipitating the aforementioned problems.

In a search for better and lower cost alternatives, it has been discovered that marble, in some respects, provides an improvement to the use of limestone. However, marble has other drawbacks which are believed to be significant. For example, marble does not blend well with brick from an aesthetic perspective and marble is quite expensive. Since marble is not made in what one would regard as the correct block sizes, there would be additional time, expense, and waste in having to cut the block sizes into suitable tiles. Granite is another option, though it is very expensive and the "tile" form typically comes in larger sections measuring 12 inches by 12 inches and 18 inches by 18 inches. Cutting these down to the required tile size for a suitable address stone results in a significant amount of waste. A further concern with regard to the use of granite is that while it may be aesthetically excellent on a monument structure, it is relatively unattractive when used as an address stone.

These various problems and material deficiencies or drawbacks have given rise to the conception of the present invention. In one embodiment of the present invention, an unglazed porcelain floor tile is used in combination with a suitable backing block of synthetic foam material in order to create an aesthetically excellent and structurally superior address stone or tile. While a block of synthetic foam material represents the preferred choice of backing material, alternative materials include concrete or lightweight concrete. Further, a reasonable alternative is to place the tile in a self-gasketing mold, apply to the back a bonding agent such as ACRYL 60, and pour perlite aggregate concrete into the mold. The combination of the porcelain tile and the synthetic backing block which are adhesively bonded together provide a decorative construction module which is suitable for inscribing and which is sized compatibly to fit within a residential brick wall and it is this decorative construction module which is the primary focus of this one embodiment of the present invention.

According to another embodiment of the present invention, the porcelain tile is attached directly to the exterior surface of the brick wall. In order to effect this result in a secure and efficient manner, a two-stage bonding method is used. First, a double-sided adhesive material (peel and stick) is applied to the rear surface of the tile and ultimately to the outer surface of the brick wall. A stronger structural adhesive is also applied between the tile and brick surface. The peel and stick material securely holds the tile to the bricks while the structural adhesive sets up and cures.

The invention embodiment of directly bonding the porcelain tile to the brick wall provides a simple, low-cost method of providing an attractive address tile. This embodiment facilitates the after market where provisions for an address tile are not made when the brick wall is initially fabricated. After the fact, the incorporation of a tile module into a brick wall requires the cutting or chipping away of mortar and the removal of one or more bricks or portions of bricks. There is a certain cost and a certain skill level required in order to perform this particular method, even though it does provide certain aesthetic advantages. When a decorative tile of the type disclosed herein is bonded directly to the brick surface with a suitable structural adhesive, the thickness of the tile shows as a raised panel as contrasted to a flush, inset mounting.

One of the concerns with simply applying a layer of adhesive and trying to stick a porcelain tile to an existing brick or stone wall is the need to apply a steady holding pressure for several minutes. Another concern is the need to prevent any movement, even slight movement of the tile. The peel and stick adhesive material which consists of a flexible foam body with adhesive layers on opposite sides addresses these concerns. If the holding pressure is not steady or if the tile moves, this will disrupt the curing process of the structural adhesive, preventing the desired bond from being achieved or conceivably preventing any bonding.

The tile-backing material module concept of the present invention opens up another market for address and decorative tiles of the type disclosed herein. Many homes employ man-made stone as a cladding material. Unlike bricks, which are laid atop one another in a bed of mortar, these man-made stones which average about 1½ inches in thickness, are installed by pressing the backs of the stones into a mortar bed which is spread upon the house or structure walls. Limestone which is very compatible aethestically with brick does not blend well with these man-made stones. There are though several colors of porcelain tiles, according to the present invention, which blend beautifully with the various color ranges of these man-made stones. Accordingly, it is envisioned that a thinner tile and backing material module can be created according to the teachings of the present invention and would work ideally for inclusion in a man-made "stone" facade.

Depending on what is inscribed in the construction module of the present invention, it may be both decorative and informative. In this regard, it is to be noted that one of the reasons for the widespread usage of address stones is their high visibility. Emergency personnel are able to see the address more easily, thereby aiding in the speed of reaching the victim. In this regard, the informative aspect of the construction module of the present invention is critical.

SUMMARY OF THE INVENTION

A decorative construction module for incorporation into the wall of a structure according to one embodiment of the present invention comprises a porcelain tile having a marking surface and opposite thereto a bonding surface, the marking surface being inscribed with marking indicia thereon and a backing block fabricated out of a synthetic foam material and being securely bonded to the bonding surface of the porcelain tile.

One object of the present invention is to provide an improved decorative construction module which may be used as an address stone for the wall of a residential structure.

Related objects and advantages of the present invention will be apparent from the following description.

DESCRIPTION OF THE PREFERRED EMBODIMENT

Figure 1:
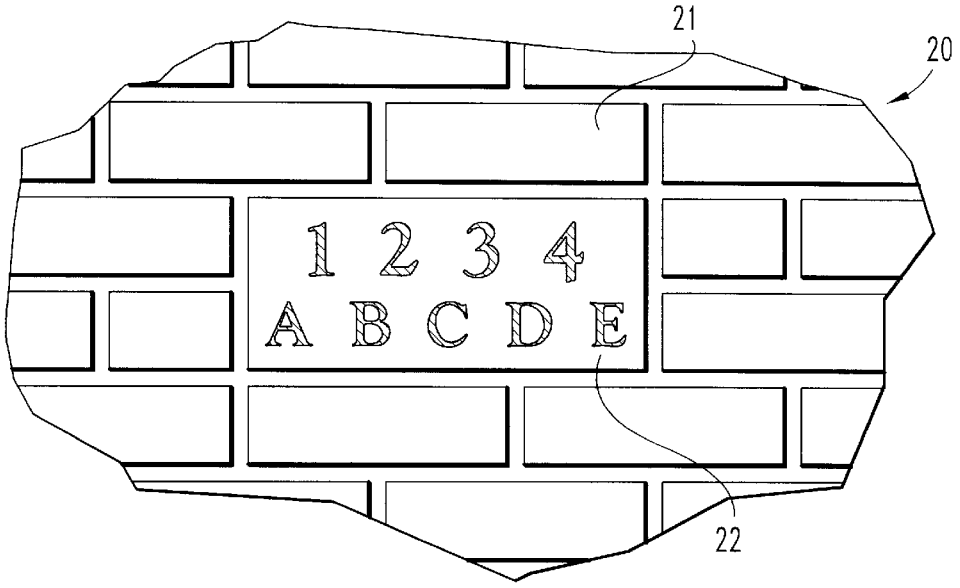
FIG. 1 is a front elevational view of a decorative construction module as installed in a brick wall according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, a brick wall 20 of a structure 21 is illustrated in partial form. Included in the brick wall 20 is a decorative construction module 22 which in the illustrated and preferred embodiment is an address stone. In lieu of an address, module 22 can be inscribed with virtually any other marking indicia such as a builder's name, a company name or trademark, or the occupant's name.

Figure 2:
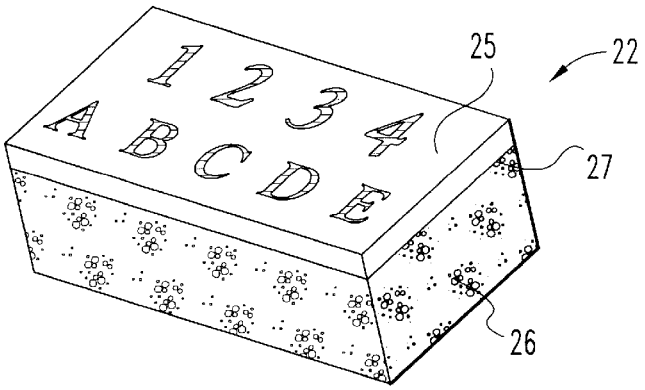
FIG. 2 is a perspective view of the FIG. 1 decorative construction module.

Referring to FIG. 2, module 22 is a rectangular solid wherein virtually all of the surfaces are smooth, substantially flat, and planar with all edges and corners being substantially right angles. The length and width of module 22 are selected so as to fit within a conventional brick wall so that the peripheral edges are located on mortar joint centerlines. The thickness of module 22 or its depth into the wall 20 is substantially the same as the thickness of the conventional bricks which are used in wall 20.

The uniformity and predictability as to the size of residential bricks enables module 22 to be prepared in any one of several standard sizes in both the length and width dimensions. For example, module 22 can be two bricks long by two or three bricks high, allowing for the thickness of the corresponding mortar joints.

With continued reference to FIG. 2, module 22 includes an outer tile 25 and a thicker backing block 26. Tile 25 is a porcelain tile which is approximately ⅜ inch thick and is adhesively bonded to backing block 26 by use of a suitable bonding material 27. In the preferred embodiment, block 26 is fabricated from an expanded polystyrene material which is approximately 3¼ inches thick. The combined thickness of the tile 25 and block 26 of approximately 3⅝ inches substantially coincides with the thickness of a standard residential brick.

Generally speaking the material composition of tile 25 is porcelain. However, for the disclosed application the preferred porcelain composition for the present invention is any frost-proof ceramic tile, glazed or unglazed, or a similarly durable man-made, porcelain-type material. Porcelain material of this type when produced in the form of tiles typically come in sizes 11⅝ inches by 11⅝ inches and 15⅝ inches by 15⅝ inches. These dimensions are significant due to the standard brick sizes and mortar joint spacing in a typical residential structure. A large porcelain tile of 15⅝ by 15⅝ inches will yield three smaller tiles, each measuring approximately 5 inches by 15⅝ inches with virtually no waste of the porcelain material. If a tile of 11⅝ by 11⅝ inches is selected, it will yield two smaller tiles each measuring 5 inches by 11⅝ inches with only a small amount of wasted material. These smaller tile sizes are somewhere between a good fit and a near perfect fit into a residential brick wall using typical residential bricks and standard mortar joint spacing.

In contrast to the very advantageous standard tile sizing for porcelain, granite (in tile form) is typically ¾ inch thick and measures either 12 by 12 or 18 by 18. Cutting these down to a nominal 5 by 16 or even 5 by 12 leaves substantial waste, not to mention the added weight and cost due to the added, and unnecessary, thickness.

The porcelain tiles of the present invention are colored during the original fabrication process. The material may be precisely and smoothly cut by means of a diamond-blade power table saw.

Backing block 26, made of expanded polystyrene material, is easily adherable to other materials such as porcelain tile 25. Further, this synthetic material is effectively immune to deterioration from the constituents of a masonry wall and strong enough to withstand the forces and stresses to which it will be subjected in this particular application. The use of an expanded polystyrene backing block reduces the weight of the module 22 compared to limestone, for example. A 5 inch by 16 inch limestone address stone weighs approximately 23 pounds while a 5 inch by 15⅝ inch porcelain tile (⅜ inch thick) attached to a 5 inch by 15⅝ inch by 3¼ inch 2 pound density expanded polystyrene block weighs less than 3 pounds. This difference of approximately 20 pounds results in a cost reduction in shipping of approximately $3.00 for a typical shipping distance of approximately 300 miles. Another favorable aspect of the porcelain tile/expanded polystyrene block composite is the lack of shipping fragility. In order to guard against the hazards of shipping due to rough or careless handling, address stones/tiles of this type need to be well protected. The lighter weight of the composite of the present invention plus the strength of the porcelain tile permits less in the way of packaging precautions, reducing the cost even further.

Figure 3:
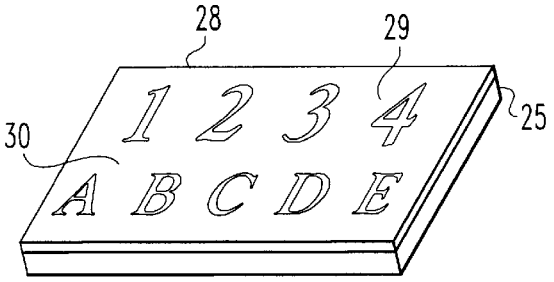
FIG. 3 is a perspective view of a stencil arrangement for use in creating marking indicia on the FIG. 1 decorative construction module.

With reference to FIG. 3, etching or inscribing is done conventionally by adhering a stencil-mask 28 to the surface of the tile 25 and sandblasting. Cut outs 29 and 30 for numbers and letters, respectively, are created in the stencil-mask 28 for the aggregate to have access to the surface of the tile 25. The actual aggregate which is used is $AlO_2$, not sand.

Bonding of the tile to the backing block can be done with several adhesive materials, such as epoxy, acrylic, urethane, and silicone. Regardless of whether the backing block is a synthetic foam material or lightweight concrete, suitable bonding agents would be known to persons of ordinary skill in the art. For the present invention, acrylic, silicone and epoxy are regarded as suitable adhesive materials.

The advantages of the decorative construction module 22 of the present invention over competing combinations and composites include a choice of colors, more precise inscription, lighter weight resulting in lower shipping charges, a composite which is impervious to construction cleaning methods, a composite which is impervious to contamination by substances intrinsic in the stone and/or the surrounding masonry, and a unique color compatibility with man-made stone.

The tile-backing material module of the present invention opens up another opportunity and market for address tiles of this type. Many homes employ man-made stone as a cladding material. Unlike brick which is laid atop one another in a bed of mortar, these man-made stones, which average approximately 1½ inches in thickness, are installed by pressing the backs of the "stones" into a mortar bed which is spread upon the outer surface of the wall of the structure. Limestone, which is compatible aesthetically with brick, does not blend well with these man-made stones. There are though several colors of porcelain tiles according to the present invention which blend beautifully with the various color ranges of this man-made stone.

Figure 4:
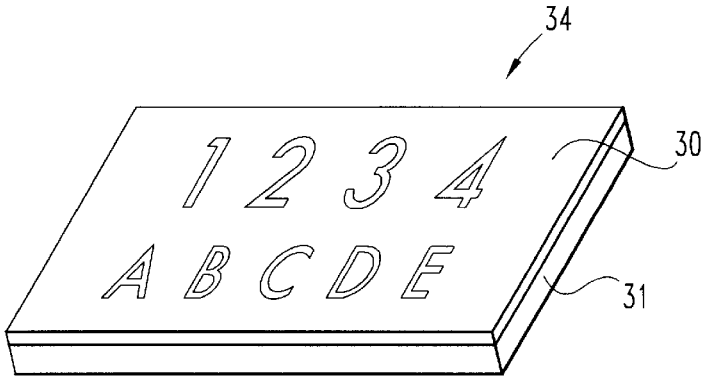
FIG. 4 is a perspective view of a decorative construction module according to a typical embodiment of the present invention.

According to another embodiment of the present invention (see FIG. 4), a ⅜ inch thick porcelain tile 30 is adhered to a 1¼ inch thick block 31 of synthetic backing material, giving an overall module thickness of 1⅝ inch which is precisely what is required for inserting the module into a man-made "stone" facade.

Figure 5:
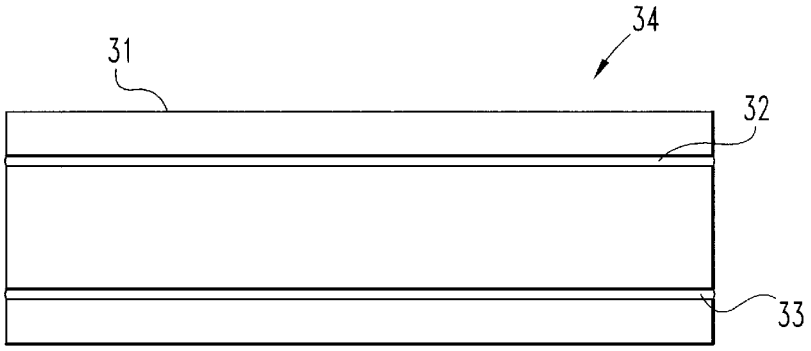
FIG. 5 is a rear elevational view of the FIG. 4 decorative construction module.

With reference to FIG. 5, synthetic block 31 has two horizontally disposed dovetail-shaped slots 32 and 33 running the length of the synthetic backing block 31. When the module 34 is to be installed, the synthetic backing block 31 is pressed into the mortar bed which is applied to the wall of the structure. As the backing block 31 is pressed into the mortar, the mortar is allowed to flow and fill, or at least partially fill, these dovetail slots 32 and 33. As the mortar locks itself into these two slots and sets up, the module 34 is held in its proper position.

Figure 6:
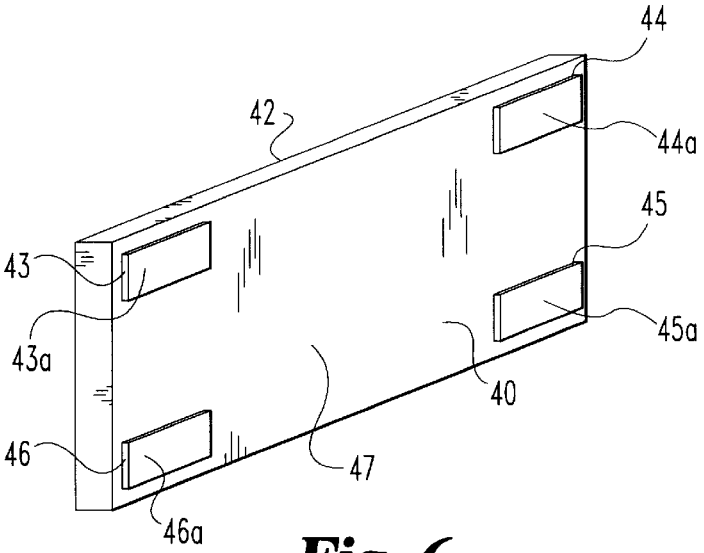
FIG. 6 is a perspective view of a decorative porcelain tile according to a typical embodiment of the present invention.
Figure 7:
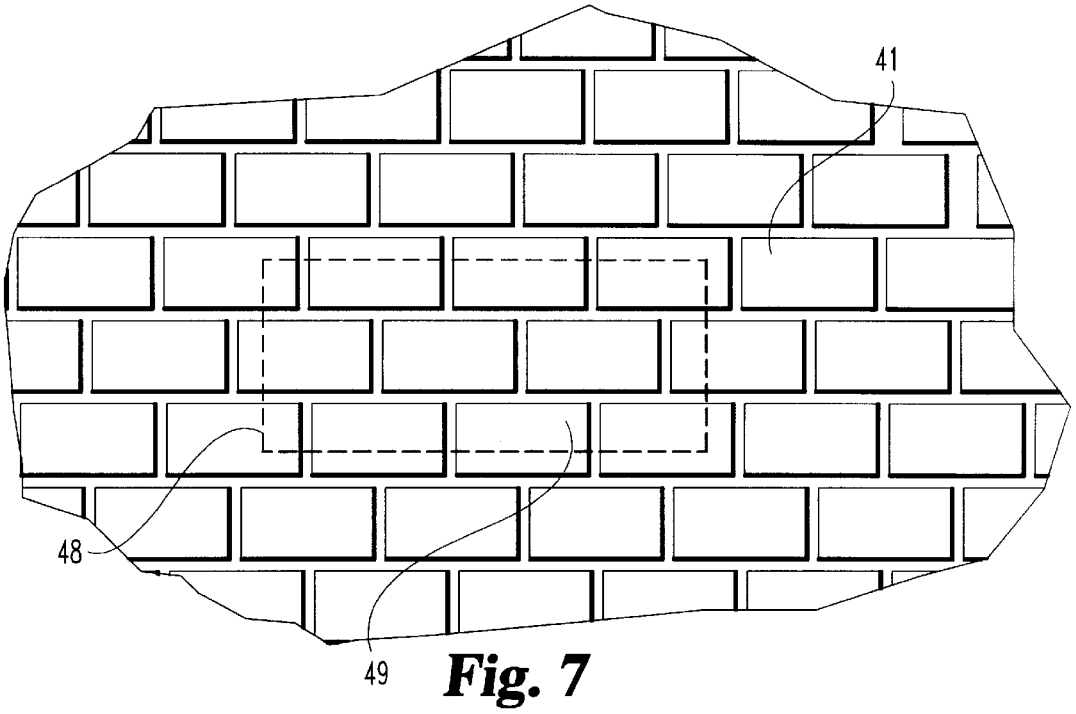
FIG. 7 is a front elevational view of a brick wall with a chalk outline thereon for locating the FIG. 6 porcelain tile.
Figure 8:
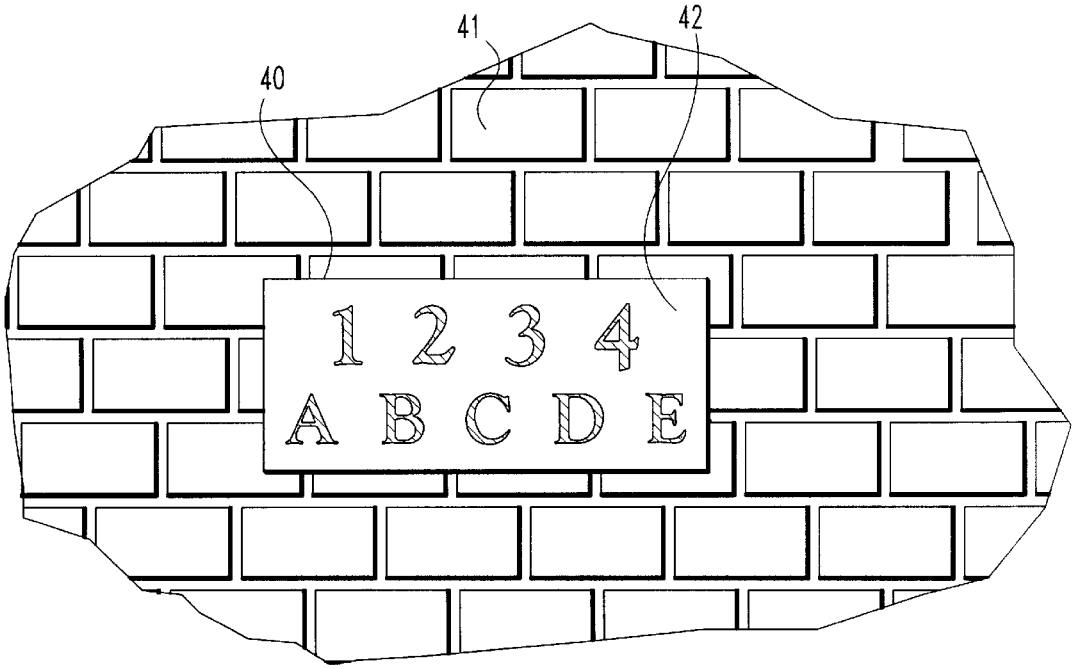
FIG. 8 is a front elevational view of the FIG. 6 porcelain tile as bonded in the correct location to the FIG. 7 brick wall.

With reference to FIGS. 6, 7, and 8, an easy and simple method of attaching a porcelain address tile 40 (or decorative tile if address information is not provided) to the wall 41 of a structure is disclosed. The apparatus includes the porcelain tile 40 whose front surface 42 is marked or etched with whatever decorative and/or informative markings may be desired. Four sections 43–46 of double-sided adhesive material of the "peel and stick" variety are adhesively bonded to the rear surface 47 of tile 40. While each thickness of material comprising sections 43–46 begins with a removeable backing layer on each side covering and thereby protecting the adhesive surfaces, one removeable backing layer is removed in order to be able to bond each of the four sections to the rear surface of the tile. This leaves the other removeable backing layer **43*a*–46*a* on each corresponding section until it is time to attach the tile 40 to the wall 41 of the structure. In the preferred embodiment, wall 41** is a brick wall.

Each section 43–46 has a thickness of approximately 3⁄16 inch and incorporates a compressible material such as a flexible foam. As indicated, these foam thicknesses which comprise sections 43–46 have an adhesive layer or coating on opposite sides and a removeable backing layer covering each adhesive layer. In order to utilize the adhesive layer on these foam sections, one simply needs to remove the corresponding backing layer which thereby exposes the adhesive and allows the foam section to be applied to a surface with the adhesive layer providing the bonding agent. The 3/16 inch thickness for these foam sections 43–46 is important in order to accommodate any surface variations, irregularities or unevenness in the brick wall 41 so that the tile 40 will lay flat without rocking.

When it is time to bond the tile 40 to the brick wall 41, the desired location for the tile is outlined with a chalk line 48 or with some other removeable marking media. Next, the installer selects a suitable structural adhesive or bonding agent, such as an acrylic, silicone, or epoxy adhesive, and will either apply the material along the top edge and sides of the outlined area 49 or will apply the structural adhesive directly to the top and side areas of tile 40. Whether the structural adhesive is applied directly to the tile or to the wall, it is important to apply the adhesive in areas which do not interfere with the foam sections 43–46. While these foam sections are illustrated as being inset from each corner of the tile in FIG. 6, virtually any location is acceptable. Whether the structural adhesive is applied to the outlined area 49 on the brick wall or to the porcelain tile 40, the bottom edge is left open in order to permit any moisture to leave or evaporate. The selected structural adhesive should possess the properties of strength, weather resistance, and resistance to heat. Resistance to heat is important because the porcelain tile tends to absorb sunlight which can substantially elevate the tile temperature over the ambient temperature.

Once the foregoing steps have been accomplished, the next step is to remove the remaining backing layers 43*a*–46*a* and thereafter position the address tile 40 into the chalk outline on the brick wall (outlined area 49) and press tile 40 firmly against the brick wall. By pressing tile 40 firmly against the brick wall, the adhesive surface of each foam section will be brought in contact with the surface of the brick wall for holding the tile in position. Additionally, the rear surface of tile 40 will press against the globs or bead of structural adhesive, causing that material to spread out uniformly between the tile and the outer surface of the brick wall.

Once the structural adhesive is fully cured, the installer applies a bead of silicone sealant (not adhesive) at the brick-to-tile edge interfaces along the top and both sides of the tile. If the chalk line or other outline marking is still visible, then it is appropriate to remove that marking for the aesthetic appearance.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A decorative construction module constructed and arranged for assembly into a wall of a structure, said decorative constructive molecule comprising:

a porcelain tile having a marking surface and opposite thereto a bonding surface, said marking surface being inscribed with marking indicia thereon; and a backing block fabricated out of a synthetic foam material and being securely bonded to said bonding surface.

2. The decorative construction module of claim 1 wherein said porcelain tile has a thickness of less than 0.5 inch and the backing block has a thickness of at least 1.0 inches.

3. The decorative construction module of claim 2 wherein the porcelain tile has a shape which is substantially rectangular with a length-to-width ratio of at least 2:1.

4. The decorative construction module of claim 3 wherein the porcelain tile has a peripheral edge which defines the substantially rectangular shape and the backing block has a peripheral edge which coincides in size and shape with the porcelain tile peripheral edge.

5. The decorative construction module of claim 4 wherein the bonding together of said porcelain tile and said backing block is achieved by the use of a silicone material.

6. The decorative construction module of claim 1 wherein the porcelain tile has a thickness of approximately 3/8 inch, a length of approximately 15 5/8 inches, and a width of approximately 5 inches and the backing block measures approximately 3 1/4 inches by 15 5/8 by 5 inches.

7. The decorative construction module of claim 1 wherein the porcelain tile has a thickness of approximately 3/8 inch, a length of approximately 11 5/8 inches, and a width of approximately 5 inches and the backing block measures approximately 3 1/4 inches by 11 5/8 by 5 inches.

8. In combination:

a structural brick wall; and a decorative construction module constructed and arranged for assembly into said brick wall, said decorative construction module comprising:

a porcelain tile having a marking surface and opposite thereto a bonding surface, said marking surface being inscribed with marking indicia thereon; and a backing block fabricated out of a synthetic foam material and being securely bonded to said bonding surface.

9. The combination of claim 8 wherein said porcelain tile has a thickness of less than 0.5 inch and the backing block has a thickness of at least 1.0 inches.

10. The combination of claim 9 wherein the porcelain tile has a shape which is substantially rectangular with a length-to-width ratio of at least 2:1.

11. The combination of claim 10 wherein the porcelain tile has a peripheral edge which defines the substantially rectangular shape and the backing block has a peripheral edge which coincides in size and shape with the porcelain tile peripheral edge.

12. The combination of claim 11 wherein the bonding together of said porcelain tile and said backing block is achieved by the use of a silicone material.

13. The combination of claim 8 wherein the porcelain tile has a thickness of approximately 3/8 inch, a length of approximately 15 5/8 inches, and a width of approximately 5 inches and the backing block measures approximately 3 1/4 inches by 15 5/8 by 5 inches.

14. The combination of claim 8 wherein the porcelain tile has a thickness of approximately 3/8 inch, a length of approximately 11 5/8 inches, and a width of approximately 5 inches and the backing block measures approximately 3 1/4 inches by 11 5/8 by 5 inches.

15. A decorative construction module constructed and arranged for assembly into a wall of a structure, said decorative construction module comprising:

a porcelain tile having a marking surface and opposite thereto a bonding surface, said marking surface being inscribed with marking indicia thereon; and a backing block fabricated out of lightweight concrete and being securely bonded to said bonding surface.

16. The decorative construction module of claim 15 wherein said porcelain tile has a thickness of less than 0.5 inch and the backing block has a thickness of at least 1.0 inches.

17. The decorative construction module of claim 16 wherein the porcelain tile has a shape which is substantially rectangular with a length-to-width ratio of at least 2:1.

18. The decorative construction module of claim 17 wherein the porcelain tile has a peripheral edge which defines the substantially rectangular shape and the backing block has a peripheral edge which coincides in size and shape with the porcelain tile peripheral edge.

19. The decorative construction module of claim 18 wherein the bonding together of said porcelain tile and said backing block is achieved by the use of a silicone material.

20. The decorative construction module of claim 15 wherein the porcelain tile has a thickness of approximately ⅜ inch, a length of approximately 15⅝ inches, and a width of approximately 5 inches and the backing block measures approximately 3¼ inches by 15⅝ by 5 inches.

21. The decorative construction module of claim 15 wherein the porcelain tile has a thickness of approximately ⅜ inch, a length of approximately 11⅝ inches, and a width of approximately 5 inches and the backing block measures approximately 3¼ inches by 11⅝ by 5 inches.

22. A decorative construction module constructed and arranged for assembly to a wall of a structure, said decorative construction module comprising:

a porcelain tile having a marking surface and opposite thereto a bonding surface, said marking surface being inscribed with marking indicia thereon; and a panel of foam tape having an adhesive layer on a first side for bonding said panel to said bonding surface and further having an adhesive layer on a second surface for assembly of said decorative construction module to said wall.

* * * * *